US011043175B1

(12) United States Patent
Fu

(10) Patent No.: US 11,043,175 B1
(45) Date of Patent: Jun. 22, 2021

(54) DRIVING CIRCUIT AND DISPLAY PANEL USED THEREFOR

(71) Applicant: TCL CHINA STAR OPTOELECTRONICS TECHNOLOGY CO., LTD., Shenzhen (CN)

(72) Inventor: Xiaoli Fu, Shenzhen (CN)

( * ) Notice: Subject to any disclaimer, the term of this patent is extended or adjusted under 35 U.S.C. 154(b) by 0 days.

(21) Appl. No.: 17/045,496

(22) PCT Filed: Aug. 11, 2020

(86) PCT No.: PCT/CN2020/108422

§ 371 (c)(1),
(2) Date: Oct. 6, 2020

(30) Foreign Application Priority Data

Jan. 17, 2020 (CN) ..... 202010050843.8

(51) Int. Cl.
*G09G 3/36* (2006.01)

(52) U.S. Cl.
CPC ... *G09G 3/3648* (2013.01); *G09G 2310/0289* (2013.01); *G09G 2310/0291* (2013.01); *G09G 2310/08* (2013.01)

(58) Field of Classification Search
CPC ..... G09G 3/3648; G09G 2310/0289; G09G 2310/0291; G09G 2310/08
See application file for complete search history.

(56) References Cited

U.S. PATENT DOCUMENTS

2003/0146923 A1* 8/2003 Nakahira ..... H03F 3/45753 345/690
2008/0079683 A1 4/2008 Hashimoto
2017/0186392 A1* 6/2017 Kuo ..... G09G 3/3674

FOREIGN PATENT DOCUMENTS

CN 1624737 A 6/2005
CN 102195635 A 9/2011
CN 109671406 A 4/2019
CN 110264934 A 9/2019
CN 110379383 A 10/2019
CN 110930923 A 3/2020

* cited by examiner

*Primary Examiner* — Christopher J Kohlman

(57) ABSTRACT

The present invention provides a driving circuit and a display panel to which it is applied. The driving circuit applied to the display panel includes: a timing controller, a level shifter connected to the timing controller and including a first switch group, an operational amplifier connected to the first switch group, and a second switch group connected to the operational amplifier.

13 Claims, 3 Drawing Sheets

DRIVING CIRCUIT AND DISPLAY PANEL USED THEREFOR

BACKGROUND OF INVENTION

Field of Invention

The present invention relates to a circuit structure in displays, in particular to a driving circuit and a display panel used therefor.

Description of Prior Art

In recent years, with advancement of science and technology, flat-panel liquid crystal displays have gradually become popular, and have advantages of lightness and thinness. At present, a driving circuit of the flat-panel liquid crystal displays is mainly composed of an external connection IC of the panel, but this method cannot reduce a cost of product, nor can it make the panel thinner.

In addition, a liquid crystal display device usually has a gate driving circuit, a source driving circuit, and a pixel array. There are a plurality of pixel circuits in the pixel array, and each pixel circuit is turned on and off according to a sweep signal provided by the gate driving circuit, and displays a data screen according to a data signal provided by the source driving circuit. For the gate driving circuit, the gate driving circuit usually has a multi-stage shift register, and a scanning signal is outputted to the pixel array by the shift register of one stage to a next stage of shift register. The pixel circuit is turned on sequentially so that the pixel circuit receives the data signal.

Therefore, in a manufacturing process of the driving circuit, the gate driving circuit is directly fabricated on an array substrate to replace the drive chip made by the external connection IC. This is called a gate array drive (gate on array, GOA) technology. The application can be made directly around the panel, reducing a production process, reducing product costs, and making the panel thinner.

As shown in FIG. 1, an existing level shifter chip is composed of multiple level shifters, which are responsible for amplifying signals. A 12CK level shifter chip needs at least 16 such level shifters. The level shifter makes the entire level shifter chip package very large and increases cost substantially.

Inside the existing level shifter chip, a separate level shifter is required to amplify each of GOA signals, which will waste resources and increase costs.

Therefore, the main purpose of the present invention is to provide a driving circuit and a display panel used therefor to solve the above-mentioned problems.

SUMMARY OF INVENTION

Inside the existing level shifter chip, a separate level shifter is required to amplify each of GOA signals, which will waste resources and increase costs.

The purpose of the patent of the present invention is to provide a driving circuit applied to a display panel, and comprising: a timing controller, a level shifter connected to the timing controller, the level shifter comprises a first switch group, an operational amplifier connected to the first switch group, and a second switch group connected to the operational amplifier;

wherein the timing controller comprises N output pins, each of the output pins outputs a clock signal, and N is a positive integer;

the first switch group comprises N switch transistors; input ends of the N switch transistors are respectively connected to the N output pins of the timing controller, and the output ends of the N switch transistors are all connected to an input end of the operational amplifier;

the second switch group comprises M switch devices, input ends of the M switch devices are all connected to an output end of the operational amplifier, and output ends of the M switch devices are respectively connected to scan lines of the display panel;

the timing controller outputs the clock signal to the level shifter, and the level shifter outputs the clock signal from a corresponding channel to the display panel according to an on-state of the switch transistors and the switch devices to drive the display panel; and the operational amplifier further comprises a positive power end and a negative power end; each of the switch transistors is a MOS transistor, gates of the switch transistors are connected to input signals of the level shifter, sources of the switch transistors are connected to the N output pins of the timing controller, and drains of the switch transistors are connected to the input end of the operational amplifier.

In the embodiment of the present invention, M is less than or equal to the N.

In the embodiment of the present invention, a first end of the timing controller is electrically coupled to a first switch, a second end of the timing controller is electrically coupled to a second switch, a third end of the timing controller is electrically coupled to a third switch, a fourth end of the timing controller is electrically coupled to a fourth switch, a fifth end of the timing controller is electrically coupled to a fifth switch, a sixth end of the timing controller is electrically coupled to a sixth switch; a seventh end of the timing controller is electrically coupled to a seventh switch, an eighth end of the controller is electrically coupled to an eighth switch, a ninth end of the timing controller is electrically coupled to a ninth switch, a tenth end of the timing controller is electrically coupled to a tenth switch, an eleventh end of the timing controller is electrically coupled to an eleventh switch, and a twelfth end of the timing controller is electrically coupled to a twelfth switch.

The present invention also provides a driving circuit applied to a display panel, comprising: a timing controller, a level shifter connected to the timing controller and comprising a first switch group, an operational amplifier connected to the first switch group, and a second switch group connected to the operational amplifier;

wherein the timing controller comprises N output pins, each of the output pins outputs a clock signal, and N is a positive integer;

the first switch group comprises N switch transistors; input ends of the N switch transistors are respectively connected to the N output pins of the timing controller, and the output ends of the N switch transistors are all connected to an input end of the operational amplifier;

the second switch group comprises M switch devices, input ends of the M switch devices are all connected to an output end of the operational amplifier, and output ends of the M switch devices are respectively connected to scan lines of the display panel; and the timing controller outputs the clock signal to the level shifter, and the level shifter outputs the clock signal from a corresponding channel to the display panel according to an on-state of the switch transistors and the switch devices to drive the display panel.

In the embodiment of the present invention, the operational amplifier further comprises a positive power end and a negative power end.

In the embodiment of the present invention, each of the switch transistors is a MOS transistor, gates of the switch transistors are connected to input signals of the level shifter, sources of the switch transistors are connected to the N output pins of the timing controller, and drains of the switch transistors are connected to the input end of the operational amplifier.

In the embodiment of the present invention, M is less than or equal to N.

In the embodiment of the present invention, a first end of the timing controller is electrically coupled to a first switch, a second end of the timing controller is electrically coupled to a second switch, a third end of the timing controller is electrically coupled to a third switch, a fourth end of the timing controller is electrically coupled to a fourth switch, a fifth end of the timing controller is electrically coupled to a fifth switch, a sixth end of the timing controller is electrically coupled to a sixth switch, a seventh end of the timing controller is electrically coupled to a seventh switch, an eighth end of the controller is electrically coupled to an eighth switch, a ninth end of the timing controller is electrically coupled to a ninth switch, a tenth end of the timing controller is electrically coupled to a tenth switch, an eleventh end of the timing controller is electrically coupled to an eleventh switch, and a twelfth end of the timing controller is electrically coupled to a twelfth switch.

The purpose of the present invention and the solution of its technical problems can be further realized by the following technical measures.

Another purpose of the present invention is to provide a display panel, comprising:

a first substrate; and a second substrate arranged opposite to the first substrate;

the display panel further comprises a driving circuit, and the driving circuit comprises a timing controller, a level shifter connected to the timing controller and comprising a first switch group, an operational amplifier connected to the first switch group, and a second switch group connected to the operational amplifier;

wherein the timing controller comprises N output pins, each of the output pins outputs a clock signal, and N is a positive integer;

the first switch group comprises N switch transistors; input ends of the N switch transistors are respectively connected to the N output pins of the timing controller, and output ends of the N switch transistors are all connected to an input end of the operational amplifier;

the second switch group comprises M switch devices, input ends of the M switch devices are all connected to an output end of the operational amplifier, and output ends of the M switch devices are respectively connected to scan lines of the display panel; and the timing controller outputs the clock signal to the level shifter, and the level shifter outputs the clock signal from a corresponding channel to the display panel according to an on-state of the switch transistors and the switch devices to drive the display panel.

In the embodiment of the present invention, the operational amplifier further comprises a positive power end and a negative power end.

In the embodiment of the present invention, each of the switch transistors is a MOS transistor, gates of the switch transistors are connected to input signals of the level shifter, sources of the switch transistors are connected to the N output pins of the timing controller, and drains of the switch transistors are connected to the input end of the operational amplifier.

In the embodiment of the present invention, the M is less than or equal to the N.

In the embodiment of the present invention, a first end of the timing controller is electrically coupled to a first switch, a second end of the timing controller is electrically coupled to a second switch, a third end of the timing controller is electrically coupled to a third switch, a fourth end of the timing controller is electrically coupled to a fourth switch, a fifth end of the timing controller is electrically coupled to a fifth switch, a sixth end of the timing controller is electrically coupled to a sixth switch, a seventh end of the timing controller is electrically coupled to a seventh switch, an eighth end of the controller is electrically coupled to an eighth switch, a ninth end of the timing controller is electrically coupled to a ninth switch, a tenth end of the timing controller is electrically coupled to a tenth switch, an eleventh end of the timing controller is electrically coupled to an eleventh switch, and a twelfth end of the timing controller is electrically coupled to a twelfth switch.

The present invention realizes the optimization of the internal circuit of the level shift register chip and reduces the cost of the level shift register chip.

DETAILED DESCRIPTION OF PREFERRED EMBODIMENTS

Figure 1:
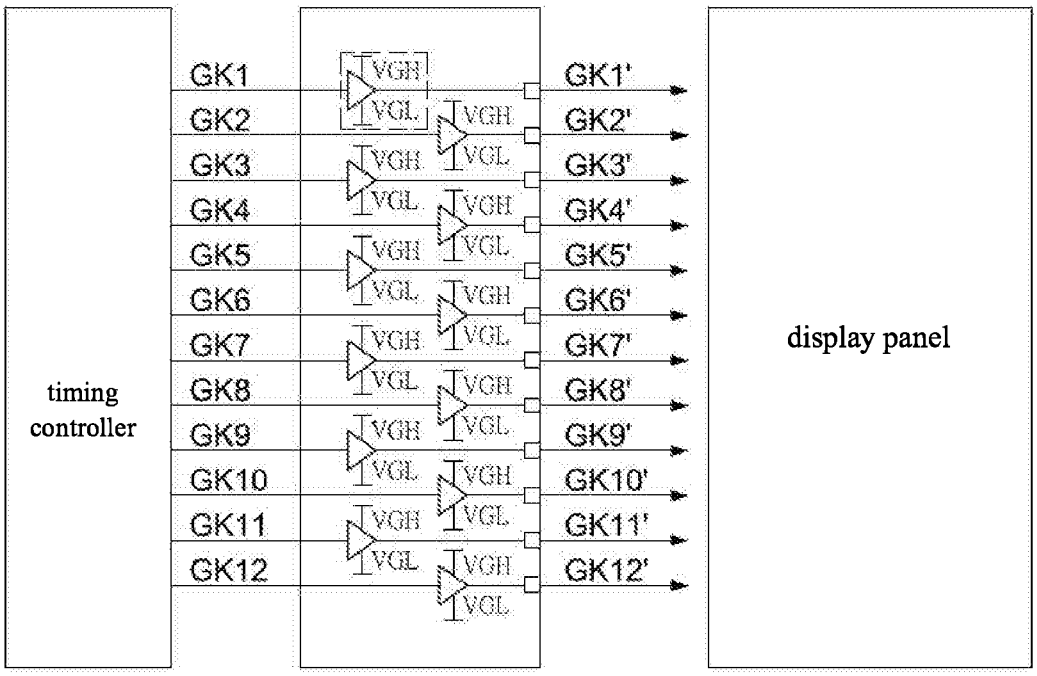
FIG. 1 is a schematic diagram of an exemplary 12-clock signal level shifter chip comprising multiple shift registers.

The description of the following embodiments refers to the attached drawings to illustrate specific embodiments that can be implemented by the present invention. The directional terms mentioned in the present invention, such as "up", "down", "front", "rear", "left", "right", "inner", "outer", "side", etc., are only Refer to the direction of the attached drawings. Therefore, the directional terms used are used to illustrate and understand the present invention, rather than to limit the present invention.

In the drawings, the thickness of layers, films, panels, regions, etc., are exaggerated for clarity. In the drawings, the thickness of some layers and regions are exaggerated for understanding and ease of description. It will be understood that when a component such as a layer, film, region, or substrate is referred to as being "on" another component, the component can be directly on the other component, or intermediate components may also be present.

The drawings and descriptions are to be regarded as illustrative in nature and not restrictive. In the figure, units with similar structures are indicated by the same reference numerals. In addition, for understanding and ease of description, the size and thickness of each component shown in the drawings are arbitrarily shown, but the present invention is not limited thereto.

In addition, in the specification, unless expressly described to the contrary, the word "comprising" will be understood as meaning comprising the components, but does not exclude any other components. In addition, in the specification, "on" means to be located above or below the target component, and does not mean that it must be located on the top based on the direction of gravity.

In order to further explain the technical means and effects adopted by the present invention to achieve the intended purpose of the present invention, in conjunction with the drawings and specific embodiments, the specific implementation of the driving circuit and the display panel used in the present invention will be given below. Structure, characteristics and effects are described in detail later.

Figure 2:
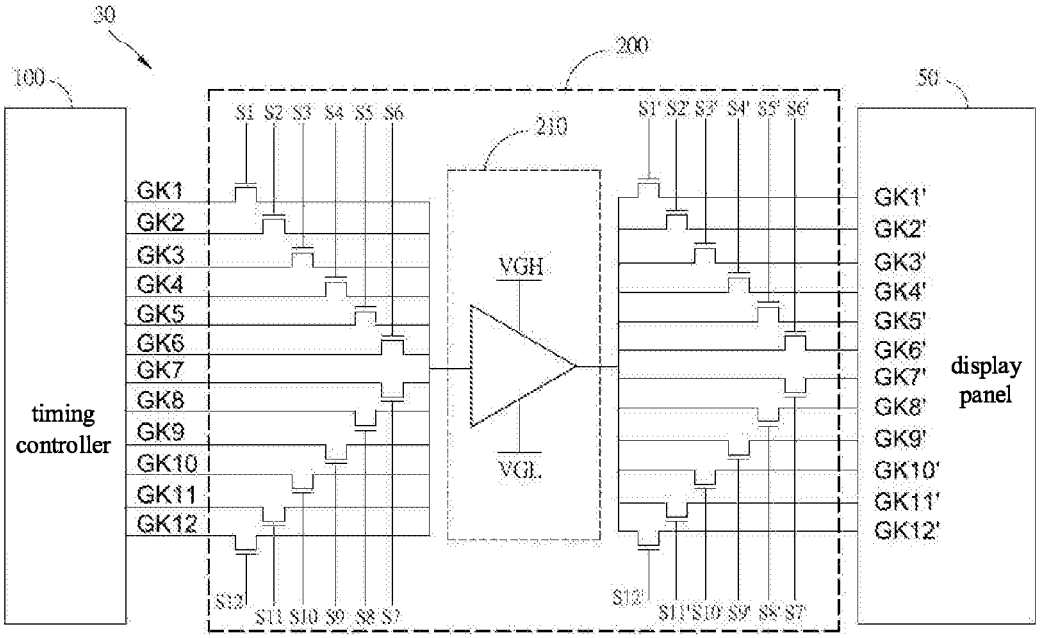
FIG. 2 is a circuit diagram of multiplexing using a single shift register according to an embodiment of the present invention.

FIG. 2 is a circuit diagram of multiplexing using a separate shift register according to an embodiment of the present invention. Please refer to FIG. 2. In an embodiment of the present invention, a driving circuit 30 comprises: a timing controller 100 and a level shifter 200 connected to the timing controller 100, wherein the level shifter 200 comprises a first switch group, an operational amplifier 210 connected to the first switch group, and a second switch group connected to the operational amplifier 210; wherein the timing controller 100 comprises N output pins, each of the output pins outputs a clock signal, and N is a positive integer; the first switch group comprises N switch transistors; input ends of the N switch transistors are respectively connected to the N output pins of the timing controller 100, and the output ends of the N switch transistors are all connected to an input end of the operational amplifier 210; the second switch group comprises M switch devices, input ends of the M switch devices are all connected to an output end of the operational amplifier 210, and the output ends of the M switch devices are respectively connected to scan lines of a display panel 50; the timing controller 100 outputs the clock signal to the level shifter 200, and the level shifter 200 outputs the clock signal from a corresponding channel to the display panel 50 according to the on-state of the switch transistors and the switch devices to drive the display panel 50.

Please refer to FIG. 2, in the embodiment of the present invention, the operational amplifier 210 further comprises a positive power end VGH and a negative power end VGL.

Please refer to FIG. 2, in the embodiment of the present invention, each of the switch transistors is a MOS transistor, gates of the switch transistors are connected to input signals of the level shifter 200, sources of the switch transistors are connected to the N output pins of the timing controller 100, and drains of the switch transistors are connected to the input end of the operational amplifier 210.

Please refer to FIG. 2. In the embodiment of the present invention, the M is less than or equal to N.

Please refer to FIG. 2, in the embodiment of the present invention, the driving circuit 30 comprises: the timing controller 100, the first switch group connected to the timing controller 100, one end of the operational amplifier 210 connected to the first switch group, and a second switch group connected to the other end of the operational amplifier 210, wherein the first switch group comprises a first switch S1 to an Nth switch S2-S12; the second switch group comprises a first switch S1' to an Mth switch S2'-S12'; where N is greater than or equal to 2 and less than 13, M is greater than or equal to 2 and less than 13, and N and M are integers.

Please refer to FIG. 2, in the embodiment of the present invention, a level shifter 200 comprises: an operational amplifier 210, one end of the operational amplifier 210 is electrically coupled to an Xth switch S1-S12, and the other end of the operational amplifier 210 is electrically coupled to a Yth switch S1'-S12', wherein X is greater than or equal to 1 and less than 13, Y is greater than or equal to 1 and less than 13, and X and Y are integers.

Please refer to FIG. 2, in the embodiment of the present invention, a first end CK1 of the timing controller 100 is electrically coupled to a first switch S1, and a G+1 end of the timing controller 100 CK2-CK12 are electrically coupled to a G+1th switch S2-S12, where G is greater than or equal to 1 and less than 12, and G is an integer.

Please refer to FIG. 2, in the embodiment of the present invention, the operational amplifier 210 further comprises a positive power end VGH and a negative power end VGL.

Please refer to FIG. 2, in the embodiment of the present invention, a first end CK1 of the timing controller 100 is electrically coupled to a first switch S1; a second end CK2 of the timing controller 100 is electrically coupled to a second switch S2.

Please refer to FIG. 2, in the embodiment of the present invention, a third end CK3 of the timing controller 100 is electrically coupled to a third switch S3; a fourth end CK4 of the timing controller 100 is electrically coupled to a fourth switch S4.

Please refer to FIG. 2, in the embodiment of the present invention, a fifth end CK5 of the timing controller 100 is electrically coupled to a fifth switch S5; a sixth end CK6 of the timing controller 100 is electrically coupled to a sixth switch S6.

Please refer to FIG. 2, in the embodiment of the present invention, a seventh end CK7 of the timing controller 100 is electrically coupled to a seventh switch S7; an eighth end CK8 of the controller 100 is electrically coupled to an eighth switch S8.

Please refer to FIG. 2, in the embodiment of the present invention, a ninth end CK9 of the timing controller 100 is electrically coupled to a ninth switch S9; a tenth end CK10 of the timing controller 100 is electrically coupled to a tenth switch S10.

Please refer to FIG. 2, in the embodiment of the present invention, an eleventh end CK11 of the timing controller 100 is electrically coupled to an eleventh switch S11.

Please refer to FIG. 2, in the embodiment of the present invention, a twelfth end CK12 of the timing controller 100 is electrically coupled to a twelfth switch S12.

Please refer to FIG. 2. In the embodiment of the present invention, only one level shifter signal operational amplifier 210 is needed, and the existing level shifter chip can be realized by cooperating with the switches S1-S12 and S1'-S12' repeated use of the functions implemented by multiple level shifter signal operational amplifiers 210 can greatly save the number of level shifters; for example, when the timing controller inputs CK1, the S1 switch is turned on, S2-S12 is off, and CK1 enters the level shifter amplifies the signal to the voltage amplitude required to drive the panel, then S1' is turned on, and S2'-S12' is turned off, so that the amplified CK signal CK1' is output to the substrate, and the panel is driven to work with other timings. The multiplexing of other gate array drive signals is shown in FIG. 2. The level shifter repeats the above process, and finally outputs the entire gate array drive sequence required to drive the panel; S1-S12 and S1'-S12 shown in FIG. 2. It can be done inside the level shifter chip or outside; there is no limit to the number of gate array drive signals.

Figure 3:
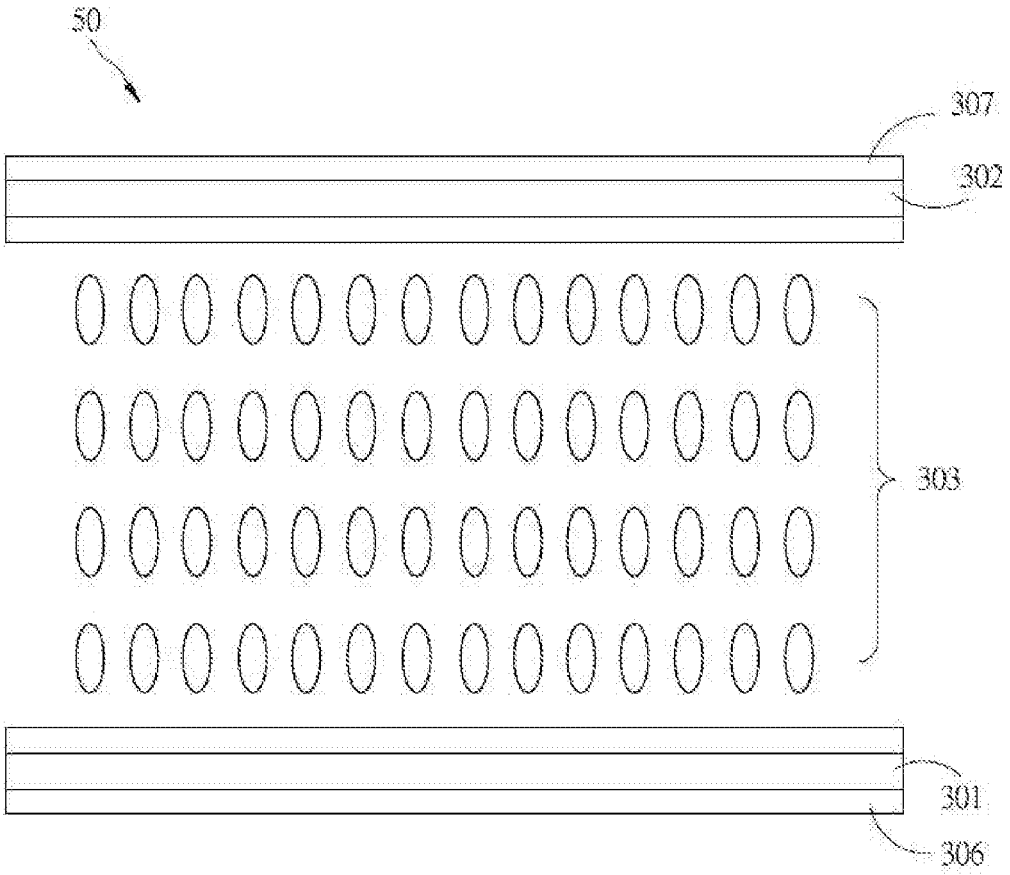
FIG. 3 is a schematic diagram of a liquid crystal display panel according to an embodiment of the present invention.

FIG. 3 is a schematic diagram of a liquid crystal display panel according to an embodiment of the present invention. Please refer to FIGS. 2 and 3, in an embodiment of the present invention, a display panel 50 includes: a first substrate 301 (such as an active array substrate); a second substrate 302 (such as a color filter substrate), which is disposed opposite to the first substrate 301; and a liquid crystal layer 303 disposed between the first substrate 301 and the second substrate 302; and further includes a shift register circuit 30 disposed between the first substrate 301 and the second substrate 302 (for example, located on the surface of the first substrate 301). And it further includes a first polarizer 306 disposed on an outer surface of the first substrate 301; and a second polarizer 307 disposed on an outer surface of the second substrate 302, wherein polarization directions of the first polarizer 306 and the second polarizer 307 are parallel to each other.

The present invention realizes the optimization of the internal circuit of the level shift register chip and reduces the cost of the level shift register chip.

The terms "in some embodiments" and "in various embodiments" are used repeatedly. The term generally does not refer to the same embodiment; but it can also refer to the same embodiment. The terms "including", "having" and "including" are synonymous, unless the context indicates other meanings.

The above are only examples of the present invention and do not limit the present invention in any form. Although the present invention has been disclosed in specific embodiments, it is not used to limit the present invention. Without departing from the scope of the technical solution of the present invention, when the technical content disclosed above can be used to make slight changes or modifications into equivalent embodiments with equivalent changes, provided that any content that does not depart from the technical solution of the present invention, Any simple modifications, equivalent changes and modifications made to the above embodiments according to the technical essence of the present invention still fall within the scope of the technical solution of the present invention.

What is claimed is:

1. A driving circuit applied to a display panel, comprising: a timing controller, a level shifter connected to the timing controller, the level shifter comprises a first switch group, an operational amplifier connected to the first switch group, and a second switch group connected to the operational amplifier;

wherein the timing controller comprises N output pins, each of the output pins outputs a clock signal, and N is a positive integer;

the first switch group comprises N switch tubes; input ends of the N switch tubes are respectively connected to the N output pins of the timing controller, and the output ends of the N switch tubes are all connected to an input end of the operational amplifier;

the second switch group comprises M switch devices, input ends of the M switch devices are all connected to an output end of the operational amplifier, and the output ends of the M switch devices are respectively connected to scan lines of the display panel;

the timing controller outputs the clock signal to the level shifter, and the level shifter outputs the clock signal from a corresponding channel to the display panel according to the on-state of the switch tubes and the switch devices to drive the display panel; and the operational amplifier further comprises a positive power end and a negative power end; each of the switch tubes is a MOS tube, gates of the switch tubes are connected to input signals of the level shifter, sources of the switch tubes are connected to the N output pins of the timing controller, and drains of the switch tubes are connected to the input end of the operational amplifier.

2. The driving circuit of claim 1, wherein the M is less than or equal to the N.

3. The driving circuit of claim 1, wherein a first end of the timing controller is electrically coupled to a first switch; a second end of the timing controller is electrically coupled to a second switch; a third end of the timing controller is electrically coupled to a third switch; a fourth end of the timing controller is electrically coupled to a fourth switch; a fifth end of the timing controller is electrically coupled to a fifth switch; a sixth end of the timing controller is electrically coupled to a sixth switch; a seventh end of the timing controller is electrically coupled to a seventh switch; an eighth end of the controller is electrically coupled to an eighth switch; a ninth end of the timing controller is electrically coupled to a ninth switch; a tenth end of the timing controller is electrically coupled to a tenth switch; an eleventh end of the timing controller is electrically coupled to an eleventh switch; and a twelfth end of the timing controller is electrically coupled to a twelfth switch.

4. A driving circuit applied to a display panel, comprising: a timing controller, a level shifter connected to the timing controller, the level shifter comprises a first switch group, an operational amplifier connected to the first switch group, and a second switch group connected to the operational amplifier;

wherein the timing controller comprises N output pins, each of the output pins outputs a clock signal, and N is a positive integer;

the first switch group comprises N switch tubes; input ends of the N switch tubes are respectively connected to the N output pins of the timing controller, and the output ends of the N switch tubes are all connected to an input end of the operational amplifier;

the second switch group comprises M switch devices, input ends of the M switch devices are all connected to an output end of the operational amplifier, and the output ends of the M switch devices are respectively connected to scan lines of the display panel; and the timing controller outputs the clock signal to the level shifter, and the level shifter outputs the clock signal from a corresponding channel to the display panel according to the on-state of the switch tubes and the switch devices to drive the display panel.

5. The driving circuit of claim 4, wherein the operational amplifier further comprises a positive power end and a negative power end.

6. The driving circuit of claim 4, wherein each of the switch tubes is a MOS tube, gates of the switch tubes are connected to input signals of the level shifter, sources of the switch tubes are connected to the N output pins of the timing controller, and drains of the switch tubes are connected to the input end of the operational amplifier.

7. The driving circuit of claim 4, wherein the M is less than or equal to the N.

8. The driving circuit of claim 4, wherein a first end of the timing controller is electrically coupled to a first switch; a second end of the timing controller is electrically coupled to a second switch; a third end of the timing controller is electrically coupled to a third switch; a fourth end of the timing controller is electrically coupled to a fourth switch; a fifth end of the timing controller is electrically coupled to a fifth switch; a sixth end of the timing controller is electrically coupled to a sixth switch; a seventh end of the timing controller is electrically coupled to a seventh switch; an eighth end of the controller is electrically coupled to an eighth switch; a ninth end of the timing controller is electrically coupled to a ninth switch; a tenth end of the timing controller is electrically coupled to a tenth switch; an eleventh end of the timing controller is electrically coupled to an eleventh switch; and a twelfth end of the timing controller is electrically coupled to a twelfth switch.

9. A display panel, comprising:

a first substrate; and a second substrate is arranged opposite to the first substrate;

the display panel further comprises a driving circuit, the driving circuit comprises: a timing controller, a level shifter connected to the timing controller, the level shifter comprises a first switch group, an operational amplifier connected to the first switch group, and a second switch group connected to the operational amplifier;

wherein the timing controller comprises N output pins, each of the output pins outputs a clock signal, and N is a positive integer;

the first switch group comprises N switch tubes; input ends of the N switch tubes are respectively connected to the N output pins of the timing controller, and the output ends of the N switch tubes are all connected to an input end of the operational amplifier;

the second switch group comprises M switch devices, input ends of the M switch devices are all connected to an output end of the operational amplifier, and the output ends of the M switch devices are respectively connected to scan lines of the display panel; and the timing controller outputs the clock signal to the level shifter, and the level shifter outputs the clock signal from a corresponding channel to the display panel according to the on-state of the switch tubes and the switch devices to drive the display panel.

10. The display panel of claim 9, wherein the operational amplifier further comprises a positive power end and a negative power end.

11. The display panel of claim 9, wherein each of the switch tubes is a MOS tube, gates of the switch tubes are connected to input signals of the level shifter, sources of the switch tubes are connected to the N output pins of the timing controller, and drains of the switch tubes are connected to the input end of the operational amplifier.

12. The display panel of claim 9, wherein the M is less than or equal to the N.

13. The display panel of claim 9, wherein a first end of the timing controller is electrically coupled to a first switch; a second end of the timing controller is electrically coupled to a second switch; a third end of the timing controller is electrically coupled to a third switch; a fourth end of the timing controller is electrically coupled to a fourth switch; a fifth end of the timing controller is electrically coupled to a fifth switch; a sixth end of the timing controller is electrically coupled to a sixth switch; a seventh end of the timing controller is electrically coupled to a seventh switch; an eighth end of the controller is electrically coupled to an eighth switch; a ninth end of the timing controller is electrically coupled to a ninth switch; a tenth end of the timing controller is electrically coupled to a tenth switch; an eleventh end of the timing controller is electrically coupled to an eleventh switch; and a twelfth end of the timing controller is electrically coupled to a twelfth switch.

* * * * *